US008771036B2

(12) United States Patent
Gentry et al.

(10) Patent No.: US 8,771,036 B2
(45) Date of Patent: Jul. 8, 2014

(54) POCKET BRA

(71) Applicants: Mariah Gentry, Seattle, WA (US); Kyle Bartlow, Bothell, WA (US)

(72) Inventors: Mariah Gentry, Seattle, WA (US); Kyle Bartlow, Bothell, WA (US)

(73) Assignee: JoeyBra, Inc., Bothell, WA (US)

( * ) Notice: Subject to any disclaimer, the term of this patent is extended or adjusted under 35 U.S.C. 154(b) by 0 days.

(21) Appl. No.: 13/870,345

(22) Filed: Apr. 25, 2013

(65) Prior Publication Data

US 2013/0288569 A1 Oct. 31, 2013

Related U.S. Application Data

(60) Provisional application No. 61/638,184, filed on Apr. 25, 2012.

(51) Int. Cl.
*A41C 3/00* (2006.01)
*A41D 27/20* (2006.01)

(52) U.S. Cl.
USPC ..... 450/89; 2/247

(58) Field of Classification Search
USPC ..... 450/89, 36, 54, 58, 81, 1; 2/247–251
See application file for complete search history.

(56) References Cited

U.S. PATENT DOCUMENTS

| | | | | |
|---|---|---|---|---|
| 2,436,430 | A | 2/1948 | Hart | |
| 4,699,144 | A * | 10/1987 | Sherwood | 450/54 |
| 5,496,205 | A | 3/1996 | Lee | |
| 5,690,537 | A * | 11/1997 | Kalmus | 450/57 |
| D448,541 | S | 10/2001 | Robinson | |
| 6,707,922 | B2 * | 3/2004 | Tilbury et al. | 381/333 |
| 7,364,491 | B2 * | 4/2008 | Updyke | 450/89 |
| 7,753,759 | B2 | 7/2010 | Pintor | |
| D646,461 | S | 10/2011 | Lewando | |
| D658,352 | S | 5/2012 | Pinner | |
| 8,484,763 | B1 | 7/2013 | Lucas | |
| 8,597,072 | B1 | 12/2013 | Lucas | |
| 2008/0032600 | A1 * | 2/2008 | Updyke | 450/89 |
| 2009/0067150 | A1 * | 3/2009 | Ito | 361/818 |

* cited by examiner

*Primary Examiner* — Gloria Hale
(74) *Attorney, Agent, or Firm* — Æ ON Law; Adam L. K. Philipp

(57) ABSTRACT

A bra comprises a pocket in a wing of the bra; the pocket may be made from the wing components or may be a separate structure; the pocket may comprise a closure, such as a zipper; the bra may comprise a high-tack material to prevent slipping of the bra when items are in the pocket.

25 Claims, 15 Drawing Sheets

POCKET BRA

CROSS-REFERENCE TO RELATED APPLICATION

This application claims the benefit of provisional application No. 61/638,184, filed Apr. 25, 2012, which application is hereby incorporated by reference in its entirety for all purposes.

FIELD

This disclosure relates to a bra with an integrated pocket.

BACKGROUND

The following description includes information that may be useful in understanding the present invention. It is not an admission that any of the information provided herein is prior art or relevant to the presently claimed invention, or that any publication specifically or implicitly referenced is prior art.

Current women's apparel does not provide many places to put personal items. Purses are a favored location for personal items, but they are bulky, expensive, are a target for theft, can be easily stolen, occupy hands and arms, can be difficult to keep track of while dancing or socializing, small items can be lost in them, are subject to being searched in various venues (such as airports, courts, and sporting events) causing delay and embarrassment, and can cause potential health problems—such as misalignment of the spine—due to weight and asymmetric weight distribution on the bearer.

Pockets are another place to put personal items. Pockets, however, are not typically found in dresses and skirts and, even when found in a garment, the pocket and/or items placed in the pocket may alter the fit or appearance of the garment in an undesirable way. Also, typical pockets can be picked and items in a pocket can be broken, such as when a person sits down with an item in a pocket. Boots also may be used to store personal items, though they are seasonal, difficult to access quickly, lack security, the item may cause discomfort when in the boot, and boots may clash with a desired outfit. Thigh holsters are also used to store personal items, though they can be difficult to access through or under pants, they can be uncomfortable, constrain movement, items in them are easily dislodged, and they are another item to remember to don and manage. Fanny packs are frequently not considered fashionable or feminine, lack organization, and are another item to remember to don and manage. Travel belts are frequently considered masculine, may not match attire, may be too thick for daily use, may be considered unprofessional, and may be difficult to access. Hands may hold personal items, but then the hand(s) are occupied, the item(s) in the hands may be exposed to weather, the items may be dropped, and socialization opportunities will be reduced when the hands are occupied. Bra cups are sometimes used to store items, between cups or inside of a cup. Bra cups, however, lack security, items can slip out, the items can be exposed to perspiration, and it may be inappropriate or inconvenient to access the bra cup to retrieve an item.

For some decades, bras have been designed with pockets to accommodate personal items. In many instances, the bra pockets were designed with "secret" pockets with limited or difficult access, or assume access only to the front of the bra, provide difficult to access pocket openings, provide only enough space for a key or similar small item, do not provide sufficient space to enclose larger items such as mobile phones, do not provide a closure which both allows access to and limits accidental release of enclosed items, require integration with the bra cup (which causes difficulties with the wide range of sizes and styles of bra cups), do not protect items from perspiration, and/or do not provide a closure or realistic opportunity for a closure (such as a zipper).

Needed is a bra with a pocket, which pocket provides sufficient space to be accommodate a mobile phone or other mobile computing device, a driver's license, credit card, keycard, medical device, or similar, wherein the bra and pocket, even with items in the pocket, is reasonably discrete, wherein access to the pocket is simple, wherein the entire interior of the pocket can be accessed with only one hand, wherein the pocket may be made to protect items from perspiration, and wherein the bra and pocket can be manufactured without customization of or integration with the bra cup.

SUMMARY

A bra comprises a pocket in a wing of the bra; the pocket may be made from the wing components or may be a separate structure; the pocket may comprise a closure, such as a zipper; the bra may comprise a high-tack material to prevent slipping of the bra when items are in the pocket.

DETAILED DESCRIPTION

Figure 1:
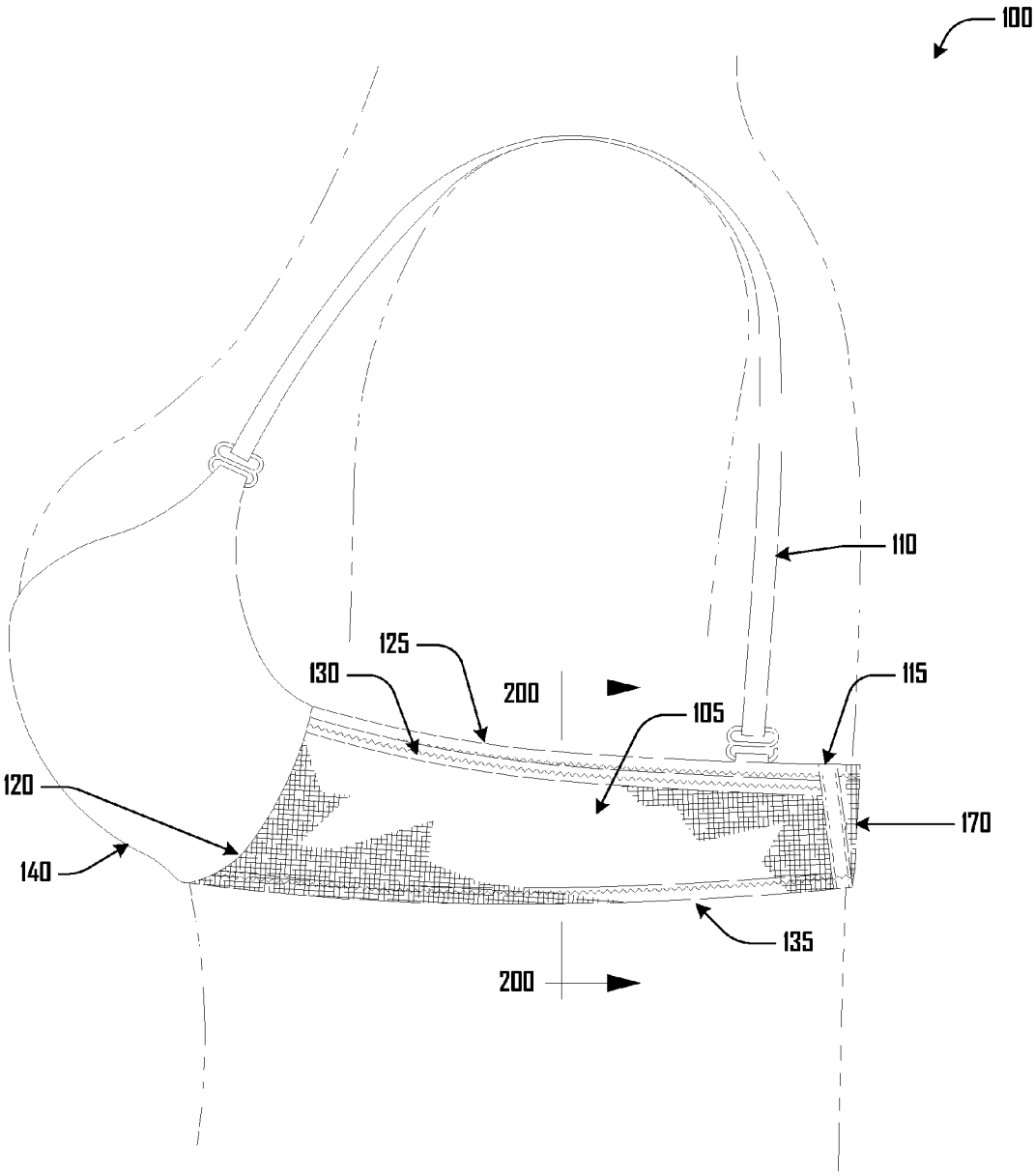
FIG. 1 is an illustration of an embodiment of a Pocket Bra.

The following Detailed Description provides specific details for an understanding of various examples of the technology. One skilled in the art will understand that the technology may be practiced without many of these details. In some instances, structures and functions have not been shown or described in detail or at all to avoid unnecessarily obscuring the description of the examples of the technology. It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." Additionally, the words, "herein," "above," "below," and words of similar import, when used in this application, shall refer to this application as a whole and not to particular portions of this application. When the context permits, words using the singular may also include the plural while words using the plural may also include the singular. The word "or," in reference to a list of two or more items, covers all of the following interpretations of the word: any of the items in the list, all of the items in the list, and any combination of one or more of the items in the list.

As used herein, "releasable," "connect," "connected," "connectable," "disconnect," "disconnected," and "disconnectable" refers to two or more structures which may be connected or disconnected, generally without the use of tools (examples of tools including needle and thread, screwdrivers, pliers, drills, saws, welding machines, torches, irons, and other heat sources) and generally in a repeatable manner. As used herein, "attach," "attached," or "attachable" refers to two or more structures or components which are attached through the use of tools or chemical or physical bonding. As used herein, "secure," "secured," or "securable" refers to two or more structures or components which are either connected or attached. As used herein, "medial" indicates toward the center of the body while "lateral" indicates away from the center of the body. As used herein, "front" means toward the front of a person and "back" or "rear" means toward a person's back. As used herein, a "wing" is a portion of a bra, generally along the side of a person's body, attached at the front either to the cup of a bra or to a cradle (which attaches to the cup); the wing may extend around to the back and may comprise one or more fasteners, such as hook-and-loop fasteners, to facilitate removal of the bra. As used herein, a "cradle" is a portion of a bra which holds the cups of the bra; the cradle may be divided in the middle and may comprise one or more fasteners to facilitate removal of the bra. The cradle may extend past the cups and may attach to the wings.

Certain elements appear in various of the Figures with the same capitalized element text, but a different element number. When referred to herein with the capitalized element text but with no element number, these references should be understood to be largely equivalent or to refer to the element in general, and to refer to any of the elements with the same capitalized element text.

Figure 2:
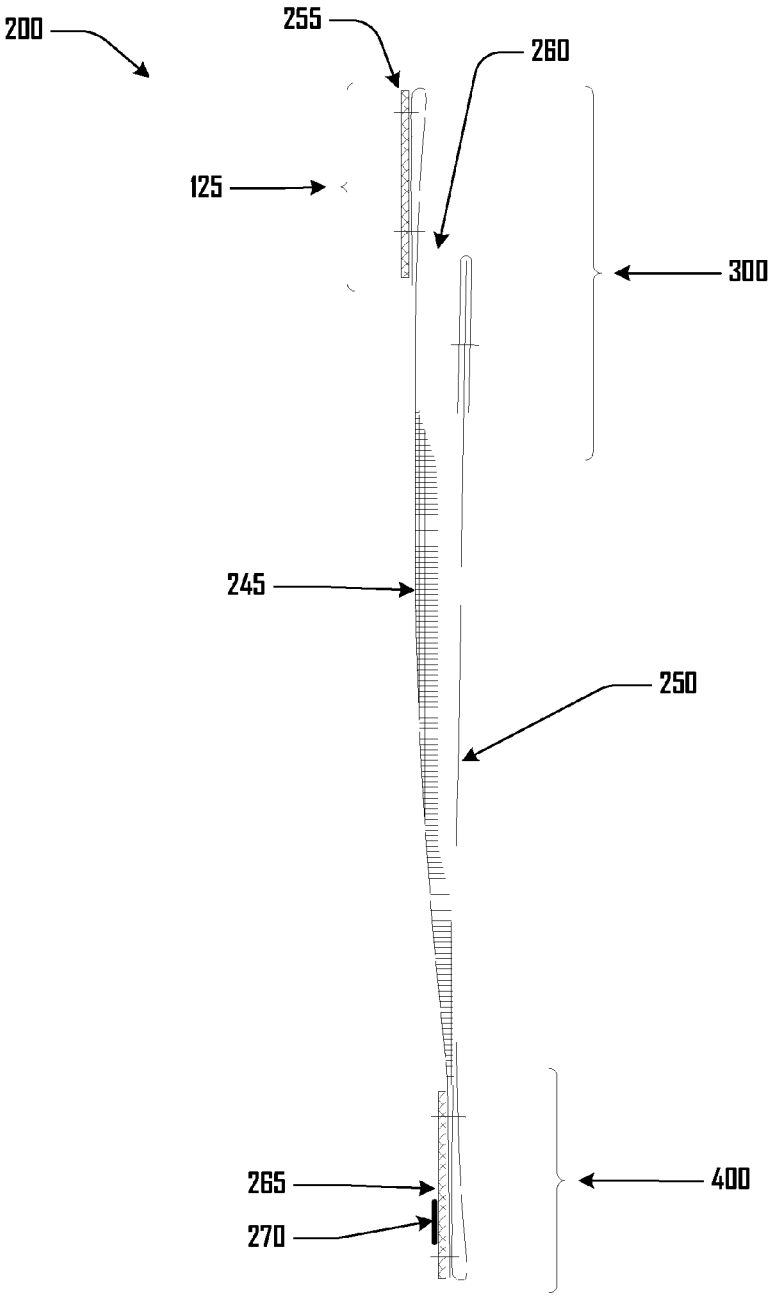
FIG. 2 is an illustration of a cross-section of the Pocket Bra disclosed in FIG. 1.
Figure 3:
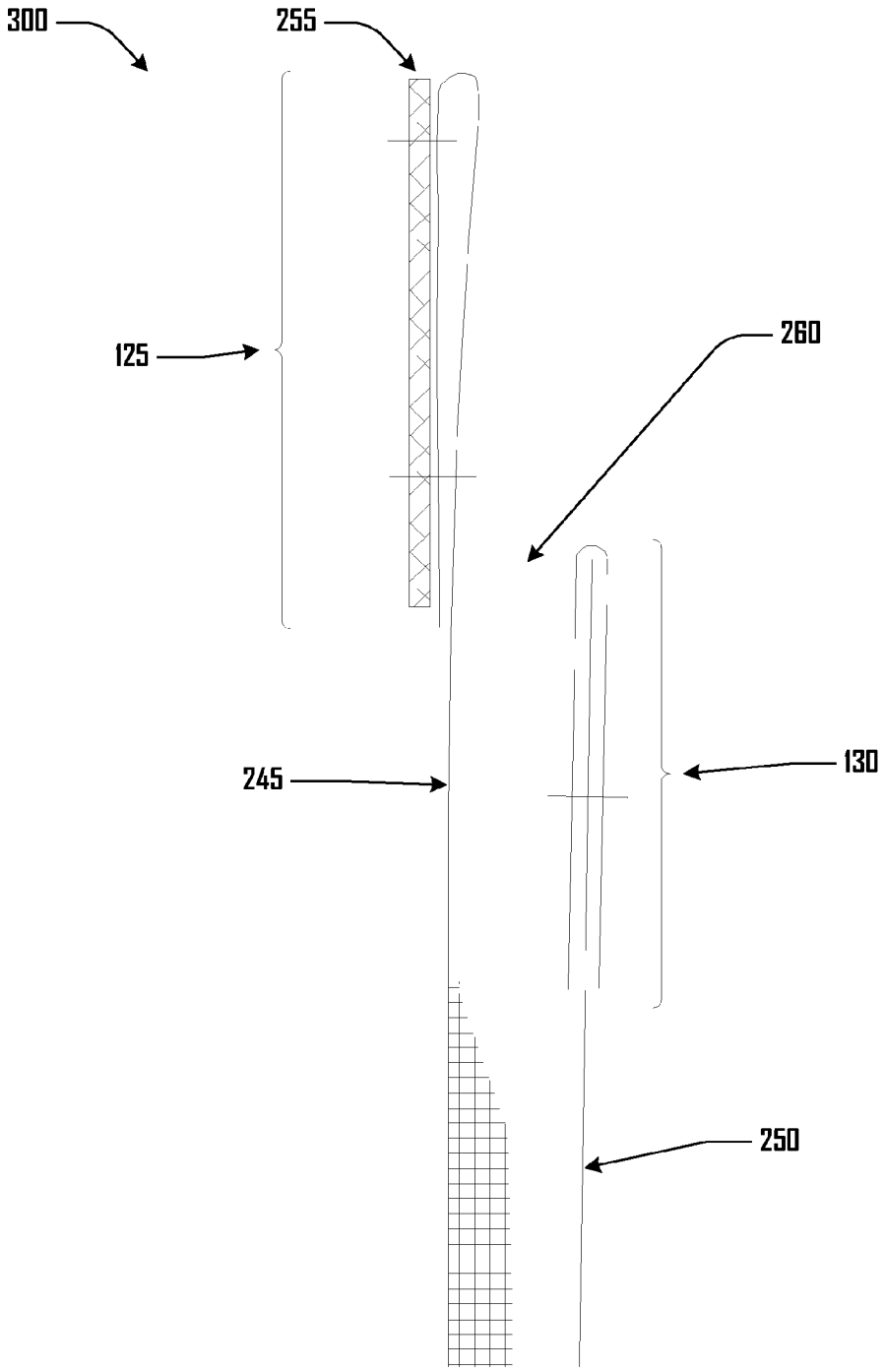
FIG. 3 is a close-up view of an upper portion of the cross-section illustrated in FIG. 2.
Figure 4:
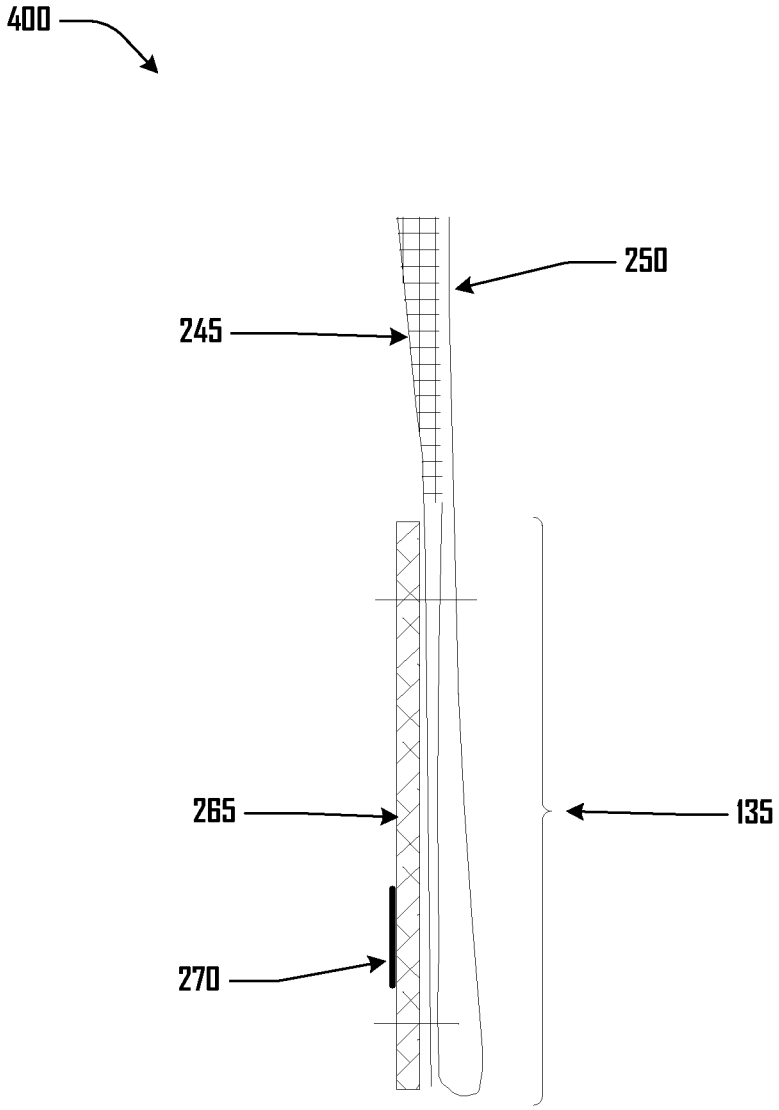
FIG. 4 is a close-up view of a lower portion of the cross-section illustrated in FIG. 2.

FIG. 1 is an illustration of an embodiment of a Pocket Bra. FIG. 2 is an illustration of a cross-section of the Pocket Bra disclosed in FIG. 1. FIG. 3 is a close-up view of an upper portion of the cross-section illustrated in FIG. 2. FIG. 4 is a close-up view of a lower portion of the cross-section illustrated in FIG. 2. These Figures illustrate a Pocket 105 in a wing of the Pocket Bra 100. The Pocket 105 is formed by two layers: A Medial Wing Layer 245 and a Lateral Wing-Pocket Layer 250. The Medial Wing Layer 245 and Lateral Wing-Pocket Layer 250 are illustrated as being attached along a Bottom Wing Hem 135. The Medial Wing Layer 245 may be topped by a Top Wing Hem 125. A Top Tape 255 may be part of the Top Wing Hem 125. The Lateral Wing-Pocket Layer 250 may be topped by a Top Pocket Hem 130. As illustrated in FIG. 1, as an example, the Top Wing Hem 125 and the Top Pocket Hem 130 may substantially overlap proximate to the Cup 140, with the amount of overlap decreasing as the Hems proceed to the Rear Pocket Seam 115. The Opening 260 of the Pocket 105 is illustrated as occurring between the Top Pocket Hem 130 and the Medial Wing Layer 245. The Opening 260 is illustrated as having portions below the level of the Top Wing Hem 125; while not necessary, this configuration facilitates accessing the Opening 260, as the wearer's hand can feel the Top Wing Hem 125 and then feel down to insert itself into the Opening 260. A Bottom Tape 265 may be part of the Bottom Wing Hem 135.

A high-tack material may be on a medial surface contacting the wearer's torso; the high-tack material may be, for example, a rubberized fabric, an elastomer, or another fabric or material which has more friction when in contact with skin, compared to other fabrics or materials. The high-tack material may be part of the Medial Wing Layer 245 and/or part of the Top Tape 255 or the Bottom Tape 265. The high-tack material may be attached to another layer, such as High-Tack Strip 270 (see FIGS. 2 and 6). The high-tack material may facilitate adherence of the Pocket Bra to the wearer and reduce shifting or movement of the Pocket Bra (relative to the torso) when in use. The high-tack material may be utilized, for example, in a strapless embodiment, such as the Strapless Pocket Bra 1300 illustrated in FIG. 13.

Figure 12:
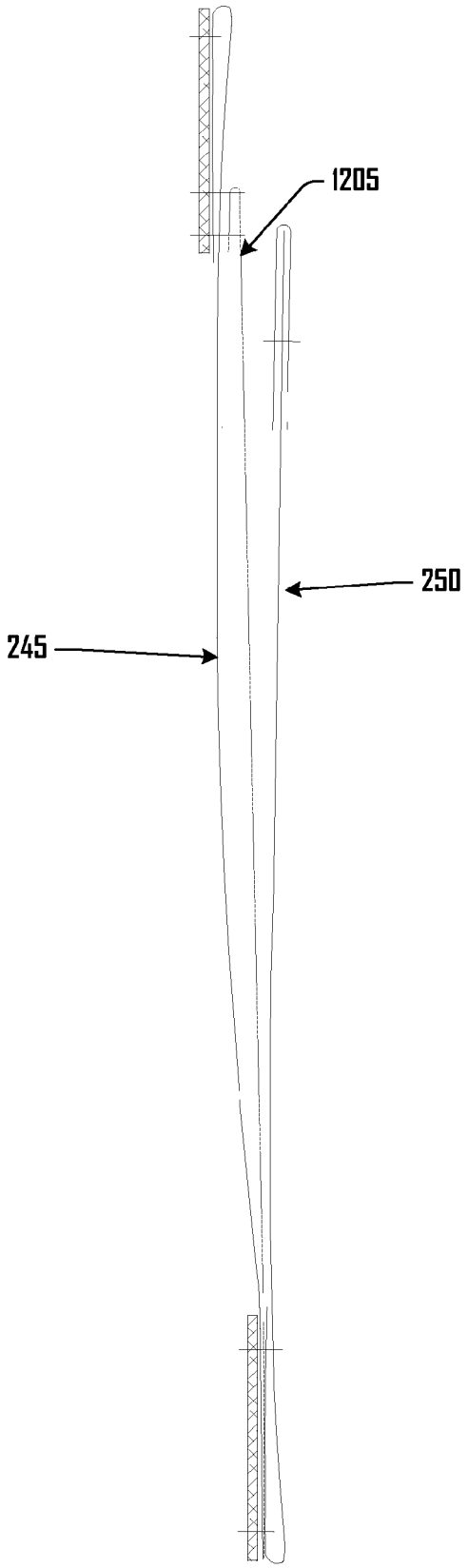
FIG. 12 illustrates an embodiment comprising a Water Resistant Layer in the cross-section illustrated in FIG. 2.

The Top Tape 255 and/or the Bottom Tape 265 may be a length of fabric; the top Tape 255 and/or the Bottom Tape 265 may be an elastomer, such as an elastic band. An elastomer may be included in the Top Pocket Hem 130. The Top Pocket Hem 130 may be provided with a small amount of extra material (relative to the Top Wing Hem 125) along the long axis of the Top Pocket Hem 130 to facilitate opening the Opening 260. The Medial Wing Layer 245 may be a water resistant material (such as Gore-Tex® or materials which may or may not also be breathable), to block or impede movement of perspiration from the torso to the Pocket 105; the Medial Wing Layer 245 may be a water wicking material, to transport perspiration away from the torso. As illustrated in FIG. 12, a Water Resistant Layer 1205 may be included between the Medial Wing Layer 245 and the Lateral Wing-Pocket Layer 250, which Water Resistant Layer 1205 may be a water resistant fabric.

The Pocket Bra 100 may comprise a Strap 110. The Pocket 105 may be bounded toward the rear by a Rear Pocket Seam 115, which Rear Pocket Seam 115 may attach the Medial Wing Layer 245 and the Lateral Wing-Pocket Layer 250. The Rear Pocket Seam 115 may be located toward the Back 170 of the Pocket Bra 100, in approximately the location just forward of where the wearer's side curves around to the wearer's back. Locating the Rear Pocket Seam 115 in this area prevents items placed in the Pocket 105 from shifting so far back as to be difficult to access. The Rear Pocket Seam 115 may be located proximate to the Strap 110; the Rear Pocket Seam 115 is illustrated as being further toward the rear than the Strap 110, though in alternative embodiments the Rear Pocket Seam 115 may be located below or in front of the Strap 110. The Pocket 105 may be bounded toward the front by a Front Seam 120; the Front Seam 120 may attach the Medial Wing Layer 245 and the Lateral Wing-Pocket Layer 250, and, optionally (and as illustrated), one of the Cups 140. In an alternative embodiment, there may be a portion between the Front Seam 120 and the Cup 140, such as a cradle and the Cups may be connected by the cradle; see, for example, FIG. 14 and elements 1405, which identify the Cradle 1405. By making the Pocket 105 separate from the Cup 140, standard wing components may be attached to Cups 140 of different size and shape, reducing manufacturing costs.

Figure 5:
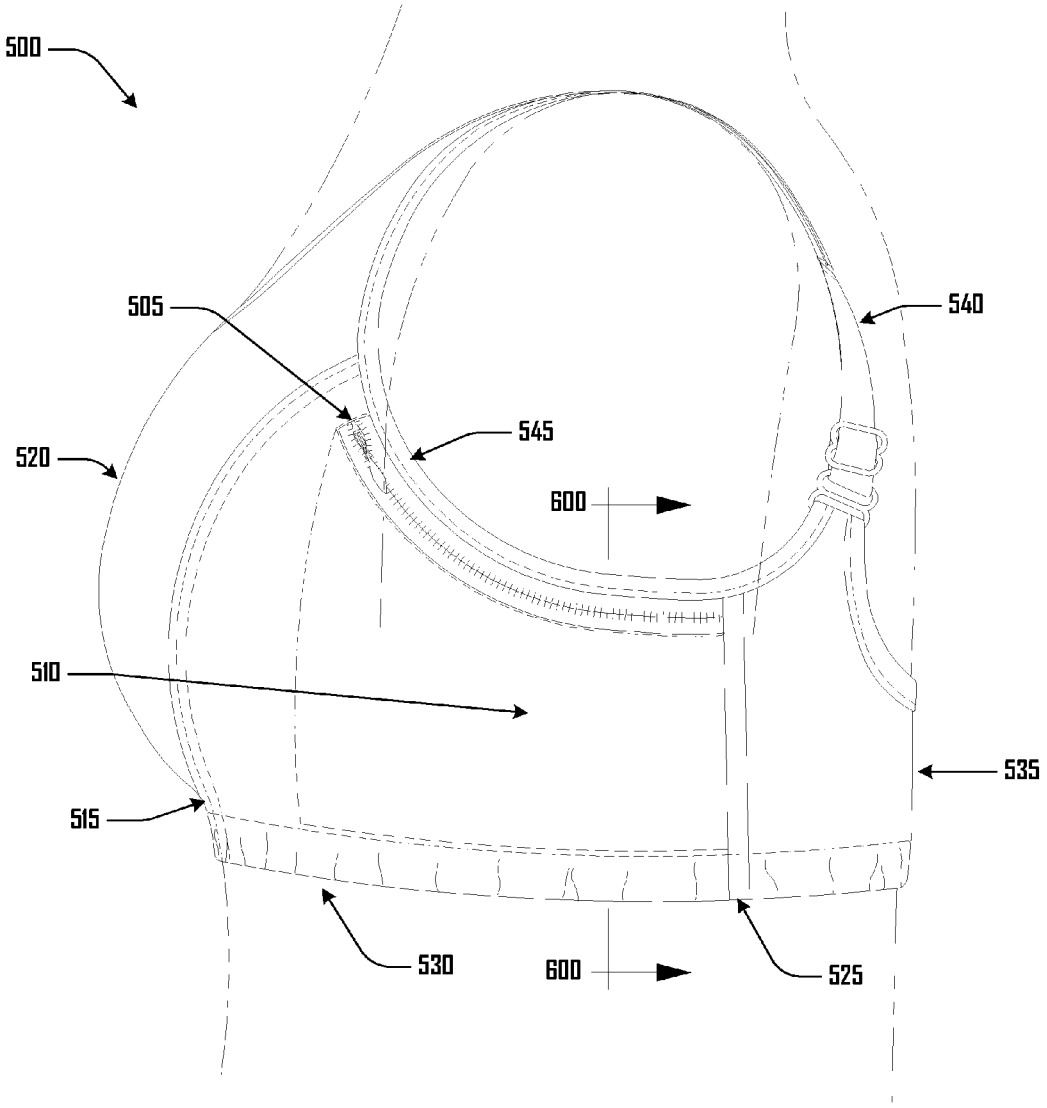
FIG. 5 is an illustration of an embodiment of a Pocket Bra with a zipper and a Pocket with an independent internal structure.
Figure 6:
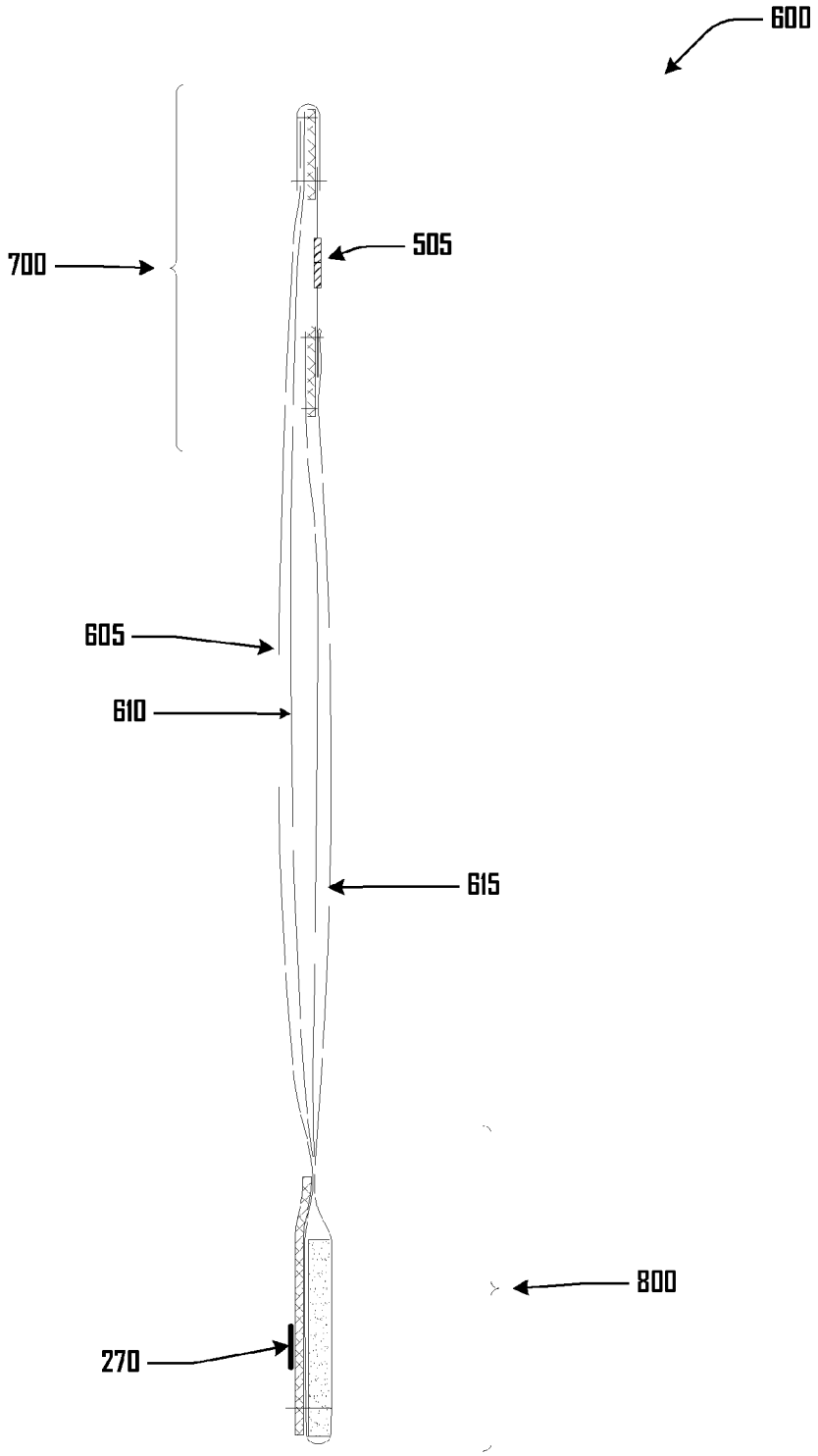
FIG. 6 is an illustration of a cross-section of the Pocket Bra disclosed in FIG. 5.
Figure 7:
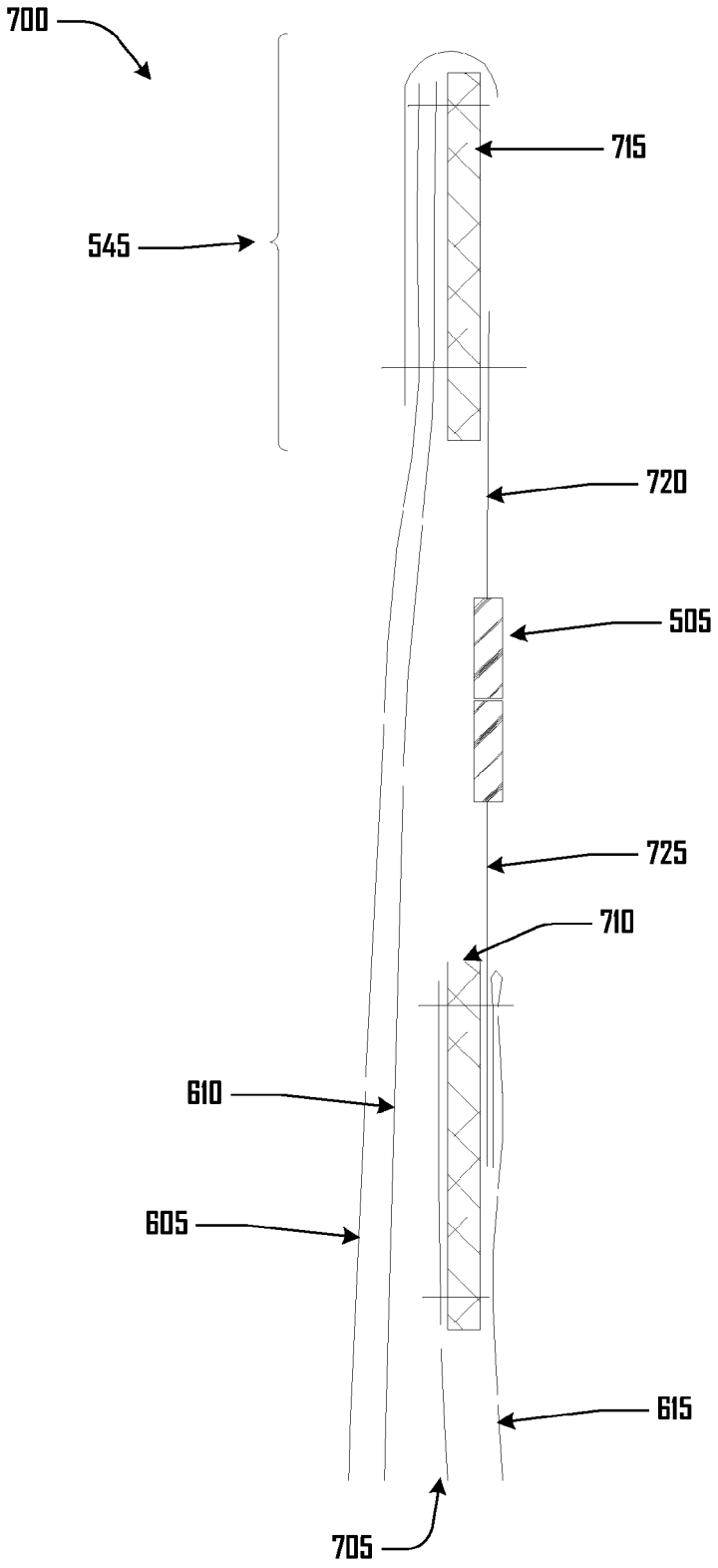
FIG. 7 is a close-up view of a portion of the cross-section illustrated in FIG. 6.
Figure 8:
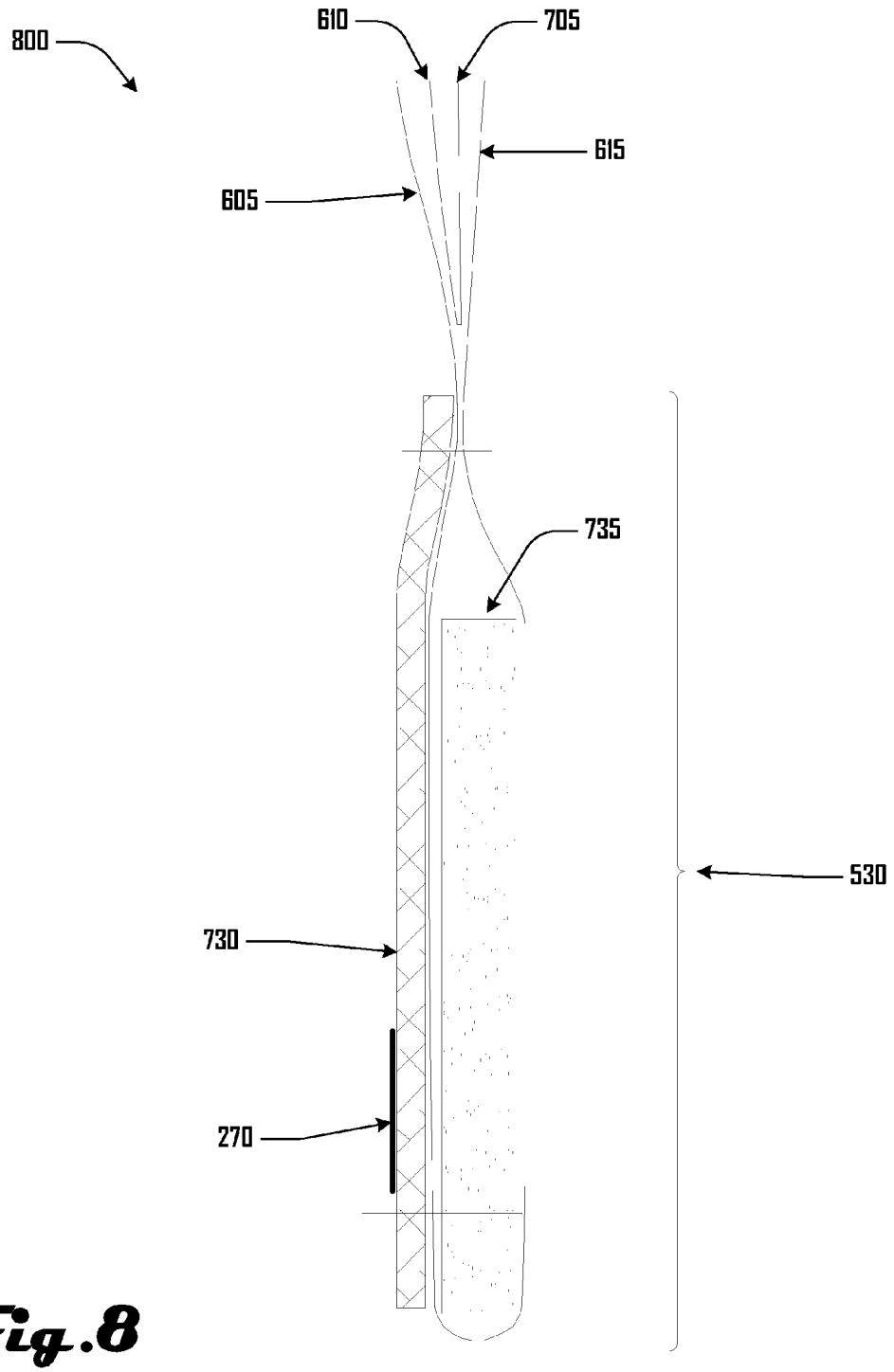
FIG. 8 is a close-up view of a portion of the cross-section illustrated in FIG. 6.

FIG. 5 is an illustration of an embodiment of a Pocket Bra with a zipper and a Pocket with an independent internal structure. FIG. 6 is an illustration of a cross-section of the Pocket Bra disclosed in FIG. 5. FIG. 7 is a close-up view of a portion of the cross-section illustrated in FIG. 6. FIG. 8 is a close-up view of a portion of the cross-section illustrated in FIG. 6. The Pocket Bra 500 illustrated in FIGS. 5 through 8 is generally designed to provide more support than the Pocket Bra illustrated in FIGS. 1 through 4 and is generally referred to herein as a "Sport Bra" and "Sport Bra 500."

The Sport Bra 500 is illustrated as comprising a Sport Bra Pocket 510, a Closure 505, a Sport Bra Cup 520, a Wing-Cup Seam 515, a Sport Bra Rear Pocket Seam 525, a Sport Bra Bottom Hem 530, a Sport Bra Top Hem 545, a Sport Bra Strap 540, a Sport Bra Medial Wing Layer 605, a Sport Bra Lateral Wing Layer 615, a Sport Bra Medial Pocket Layer 610, a Sport Bra Lateral Pocket Layer 705, a Sport Bra Top Hem 545, a Sport Bra Top Tape 715, a Sport Bra Bottom Tape 730, and a Sport Bra Back 535. The Closure 505 is illustrated as a zipper; other closures may be used, such as buttons, snaps, hook-and-loop closures (ranging in size from conventional bra fasteners to hook-and-loop such as Velcro®), magnetic closures, and other closures. The Sport Bra Medial Pocket Layer 610 and/or the Sport Bra Lateral Pocket Layer 705 may be made of a water resistant material to block or impede movement of perspiration from the torso and to protect items in the Sport Bra Pocket 510. The Sport Bra Medial Pocket Layer 610 and the Sport Bra Lateral Pocket Layer 705 may be made from one piece of fabric which is folded along the bottom margin (see, for example, FIG. 8) or along the front margin. The Sport Bra Medial Wing Layer 605 may be a water wicking material, to transport perspiration away from the torso.

FIG. 7 illustrates that the Sport Bra Top Hem 545 may attach the Sport Bra Medial Wing Layer 605, the Sport Bra Medial Pocket Layer 610, the (optional) Sport Bra Top Tape 715, and the Closure 505 (such as via the Top Closure Fabric 720). The Closure 505 may be attached (via the Bottom Closure Fabric 725) to the (optional) Closure Tape 710, the Sport Bra Lateral Pocket Layer 705, and the Sport Bra Lateral Wing Layer 615. As with the Pocket Bra 100, the Sport Bra Top Tape 715 and/or the Sport Bra Bottom Tape 730 may be a length of fabric, an elastomer, such as an elastic band, or similar.

FIG. 8 illustrates that the Sport Bra Bottom Hem 530 may attach the Sport Bra Medial Wing Layer 605, the Sport Bra Lateral Wing Layer 615, an (optional) Sport Bra Bottom Tape 730, and an (optional) Elastomer 735. FIG. 8 illustrates that the Sport Bra Pocket 510 may terminate before reaching the Sport Bra Bottom Hem 530, though in an embodiment, the Sport Bra Pocket 510 may reach and be attached to the Sport Bra Bottom Hem 530.

The Closure 505 is illustrated as being located along the bottom margin of the Sport Bra Top Hem 545. While not necessary, this configuration facilitates accessing the Closure 505, as the wearer's hand can feel the Sport Bra Top Hem 545 and then feel down to the Closure 505 and the opening into the Sport Bra Pocket 510.

The Sport Bra Rear Pocket Seam 525 may attach the Sport Bra Medial Wing Layer 605, the Sport Bra Lateral Wing Layer 615, and, optionally, may attach to some or all of the vertical length of the rear portion of the Sport Bra Pocket 510 (the Sport Bra Pocket 510 does not have to be attached to the Sport Bra Rear Pocket Seam 525). The Sport Bra Rear Pocket Seam 525 may be located toward the Back 535 of the Sport Bra 500, in approximately the location where the wearer's side curves around to the wearer's back. The Sport Bra Rear Pocket Seam 525 may be located proximate to the Strap 540; the Sport Bra Rear Pocket Seam 525 is illustrated as being further toward the front than the Strap 540, though in alternative embodiments the Sport Bra Rear Pocket Seam 525 may be located below or behind the Strap 540. The Sport Bra Pocket 510 may be bounded toward the front by a seam between the Sport Bra Medial Pocket Layer 610 and the Sport Bra Lateral Pocket Layer 705. By making the Sport Bra Pocket 510 separate from the Cups 520, standard components may attach the Sport Bra Pocket 510 to the Sport Bra Top Hem 545 and the Sport Bra Rear Pocket Seam 525, reducing manufacturing costs.

As above, a high-tack material may be on a medial surface contacting the wearer's torso. The high-tack material may be part of the Sport Bra Medial Wing Layer 605 and/or part of the Sport Bra Top Hem 545 or the Sport Bra Bottom Hem 530. A High-Tack Strip 270 may be attached to the Sport Bra Bottom Tape 730. The high-tack material may facilitate adherence of the Sport Bra to the wearer and reduce shifting or movement of the Sport Bra (relative to the torso) when in use.

As above, the Sport Bra Top Tape 715 and/or the Sport Bra Bottom Tape 730 may be a length of fabric; the Sport Bra Top Table 715 and/or the Sport Bra Bottom Tape 730 may be an elastomer, such as an elastic band.

A flap is not illustrated above the Pocket, though a flap may be included.

Aspects of the Pocket Bra 100 and the Sport Bra Pocket 510 may be combined.

Figure 9:
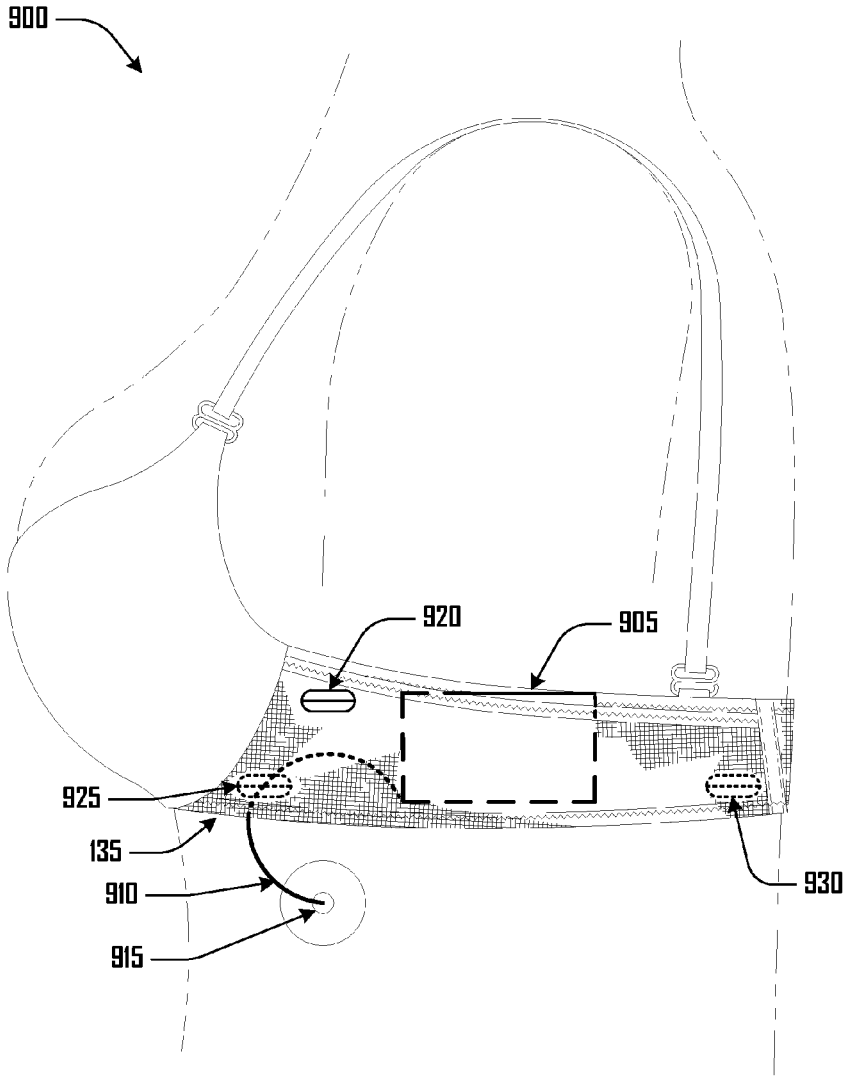
FIG. 9 illustrates the Pocket Bra illustrated in FIG. 1, further with access portals, an item in the Pocket, and a Medical Device connected to a Torso.

FIG. 9 illustrates the Pocket Bra illustrated in FIG. 1, further with access portals, an item in the Pocket, and a Medical Device connected to a Torso. The Item 905 may be a credit card, a driver's license, keys, a key-card, cosmetics, a medical device such as an insulin pump or an EPI pen, a mobile communications device (such as a cell phone), a media player, or similar. Also illustrated in FIG. 9 are a Lateral Portal 920, a Front Medial Portal 925, and a Rear Medial Portal 930. The Portals comprise openings through a layer, such as a Wing or Pocket layer; the Portals may comprise a slit or opening in the layer, with a component attached to the layer surrounding the slit or opening, which component may serve to protect the layer from forces experienced by the Portal or with a hem around the slit or opening to protect the layer from forces experienced by the Portal. The Item 905 is illustrated as comprising a Conduit 910, such as a cord for earbuds, a tube or waveguide for connection to a medical device, such as Medical Device 915, or similar. As illustrated, the Conduit 910 passes through the Front Medial Portal 925, beneath the bottom of the Bottom Hem 135, before connecting to the Medical Device 915. Other Portals may be provided in other locations, front and back, and medial and lateral.

Figure 10:
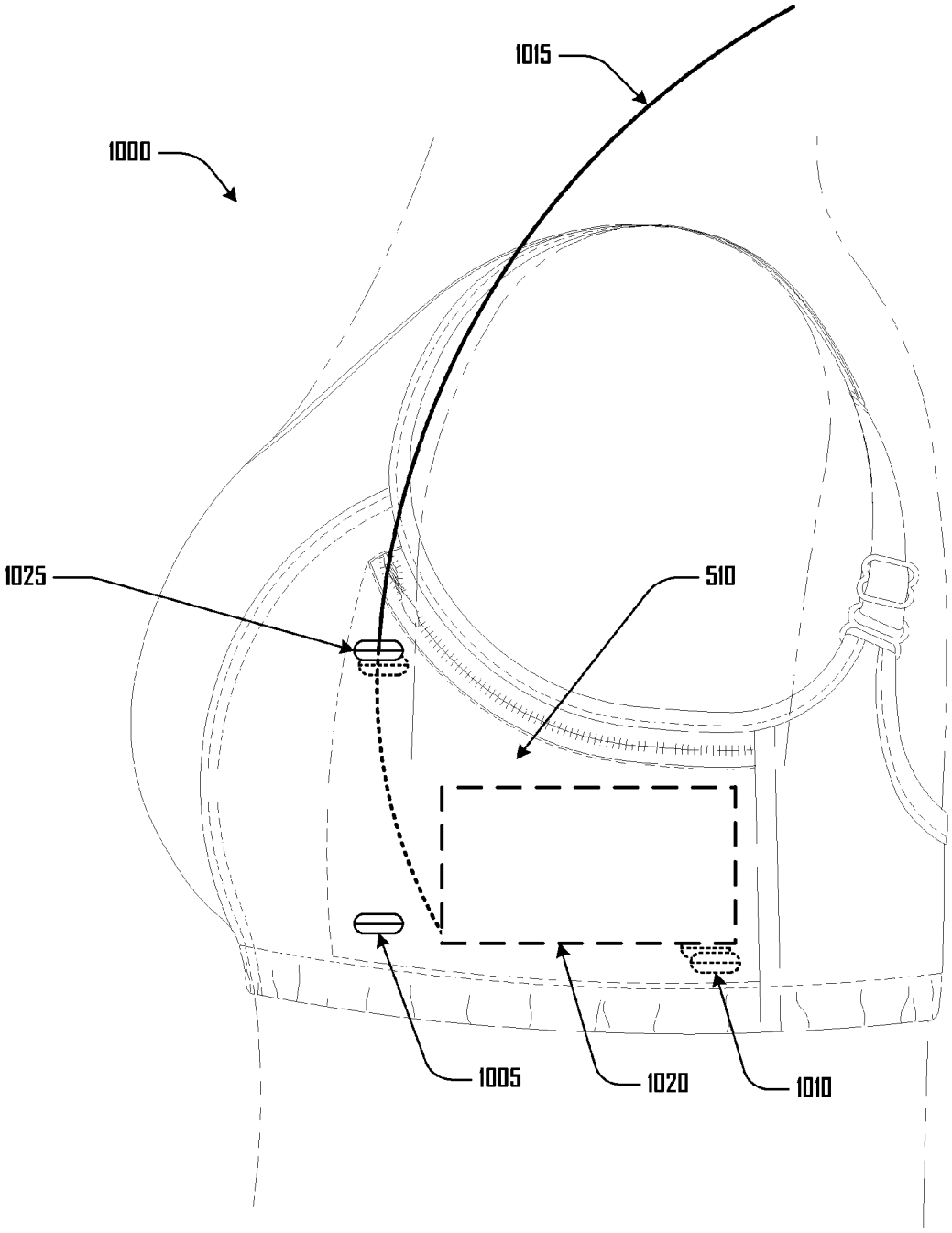
FIG. 10 illustrates the Pocket Bra illustrated in FIG. 5, further with access portals and an item in the Pocket.

FIG. 10 illustrates the Pocket Bra illustrated in FIG. 5, further with access portals and an item in the Pocket. The Portals illustrated in FIG. 10, such as Portals 1010 and 1025 may comprise a Portal in a first layer, such as a Medial or Lateral Wing Layer, and a corresponding Portal in the next proximate layer, such as a Medial or Lateral Pocket Layer (Portals with a dotted outline are behind at least one layer). The Portals illustrated at elements 1010 and 1025 in FIG. 10 are illustrated as being slightly off-set between the layers; this is for the sake of illustrative clarity in embodiments in which two proximate Portals are provided in two layers. In an embodiment, one Portal may span two layers; for example, Portal 1005 may be a single Portal which pierces and is attached to both the Lateral Wing Layer 615 and the Lateral Pocket Layer 705). The outlet of the Portals may be to the lateral side of the Bra or to the medial side. The Conduit 1015 may be an earbud cord; the Conduit 1015 is illustrated as going through the Portals at element 1025, though conduit 1015 may extend up through the Closure 505 to the ear (use of the Portals is not required). FIG. 10 also illustrates an Item 1020 in the Sports Bra Pocket 510.

Figure 11:
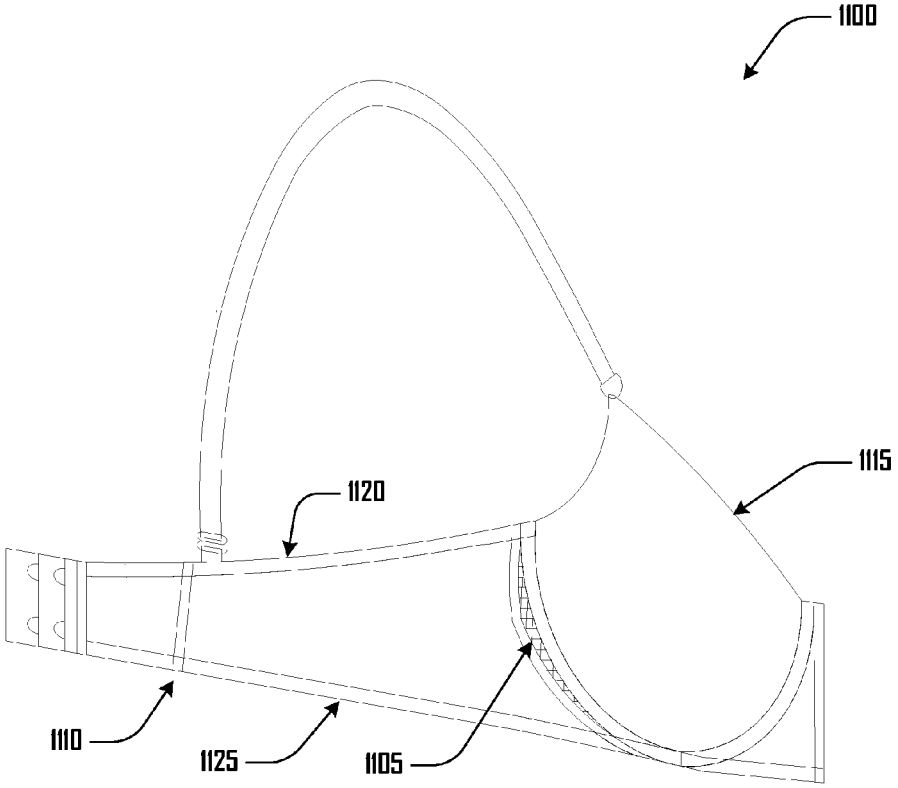
FIG. 11 illustrates a Pocket Bra with a Front-Access Pocket.

FIG. 11 illustrates a Pocket Bra with a Front-Access Pocket. The Front-Access Pocket Bra 1100 illustrated in FIG. 11 comprises a pocket with a Front-Access Pocket 1105. The Front-Access Pocket 1105 may comprise a closure along the boundary with the Cup 1115; see, for example, FIG. 14. The Front-Access Pocket Bra 1100 may comprise a Rear Seam 1110, forming a rear boundary of the Front-Access Pocket 1105. The Front-Access Pocket Bra 1100 may further comprise Medial and Lateral Wing layers, wherein the Medial and Lateral Wing layers are attached along a Top Hem 1120 and a Bottom Hem 1125 and which then form the Front-Access Pocket 1105 between them.

FIG. 12 illustrates an embodiment comprising a Water Resistant Layer in the cross-section illustrated in FIG. 2. As illustrated in FIG. 12, a Water Resistant Layer 1205 may be included between the Medial Wing Layer 245 and the Lateral Wing-Pocket Layer 250, which Water Resistant Layer 1205 may be a water resistant fabric.

Figure 13:
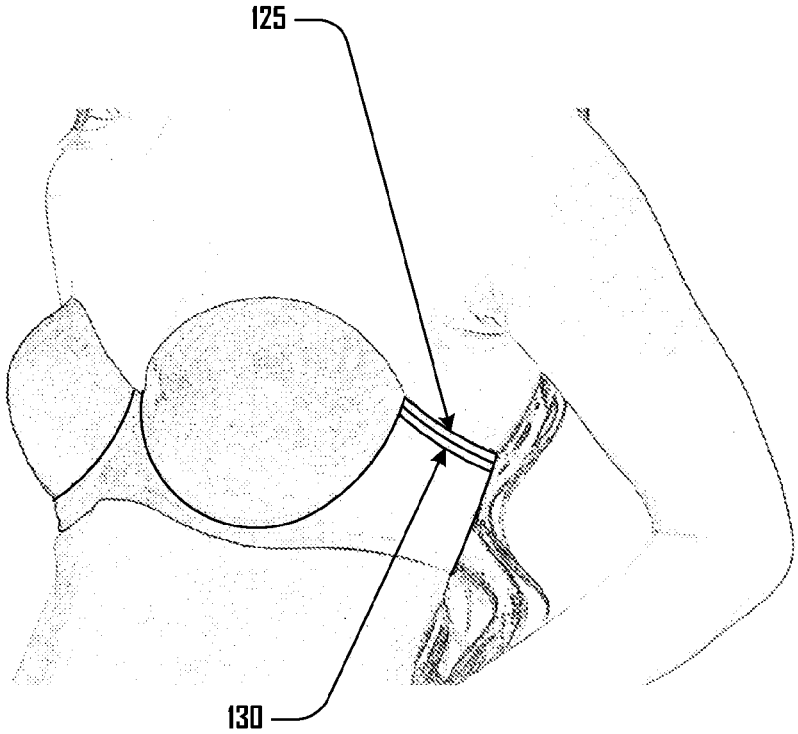
FIG. 13 illustrates a strapless embodiment of a Pocket Bra.

FIG. 13 illustrates a strapless embodiment of a Pocket Bra. This embodiment may comprise the High-Tack Strip 270 on a medial surface or layer contacting the torso. The illustration in FIG. 13 is similar to the embodiment illustrated in FIG. 1, though without the Strap 110.

Figure 14:
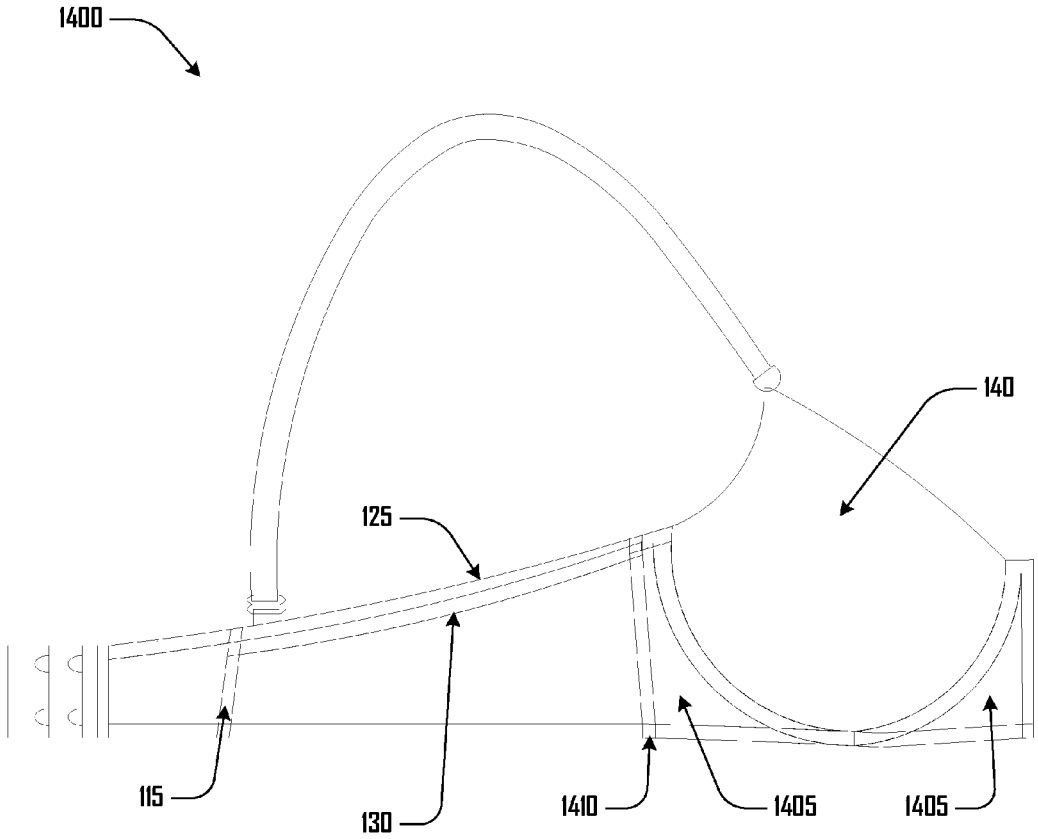
FIG. 14 illustrates an embodiment of a Pocket Bra comprising a Cradle.

FIG. 14 illustrates an embodiment of a Pocket Bra comprising a Cradle. This illustration comprises a Wing-Cradle Seam 1410, which attaches the Medial Wing Layer (such as Medial Wing Layer 235) and the Lateral Wing-Pocket Layer (such as Lateral Wing-Pocket Layer 250) before the Cup 140 (rather than attaching at the Cup 140, as illustrated in FIG. 1). The Cradle 1405 comprises components which attach the Cups 140 and which attach to the Wings.

Figure 15:
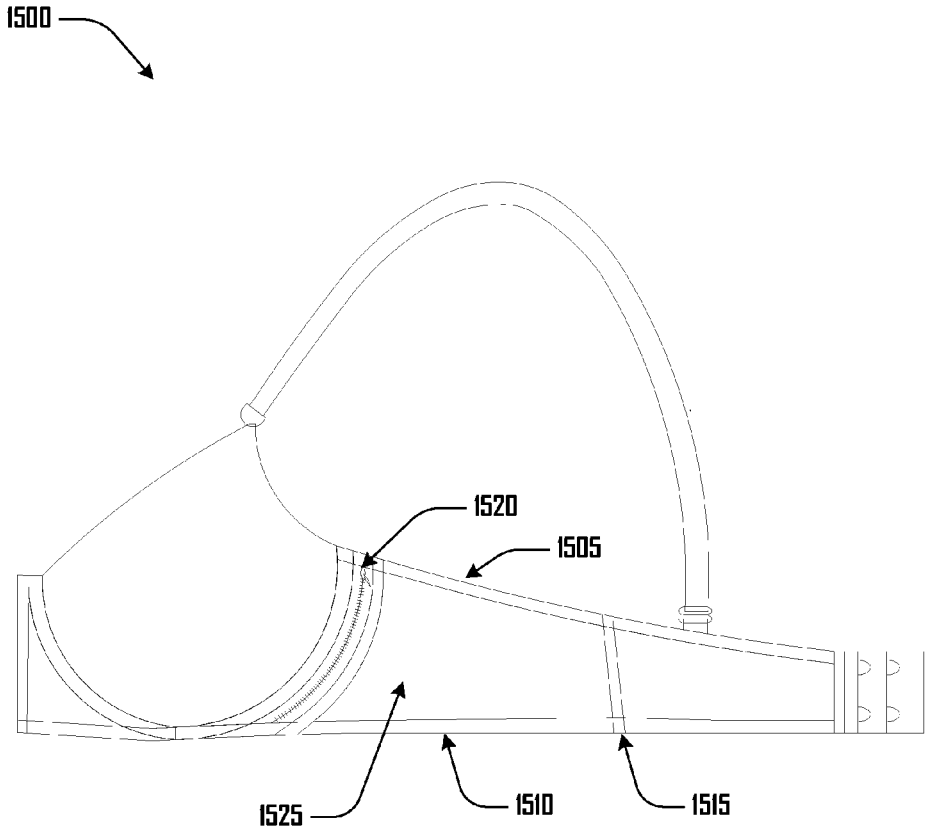
FIG. 15 illustrates a Pocket Bra with a Front-Access Pocket and a Closure.

FIG. 15 illustrates a Pocket Bra with a Front-Access Pocket and a Closure. As illustrated, the Front-Access Pocket 1525 may be formed by a Medial Wing Layer (such as Medial Wing Layer 235) and Lateral Wing-Pocket Layer (such as Lateral Wing-Pocket Layer 250), attached at the front at the Closure 1520, attached along the top at a Top Hem 1505, and attached along the bottom at a Bottom Hem 1510. As illustrated in FIG. 12, a water resistant layer may be included between the Medial Wing Layer and Lateral Wing-Pocket Layer. As illustrated in FIGS. 5-8, the Front-Access Pocket 1525 may comprise a separate internal structure.

An embodiment may include components from each of the example embodiments illustrated herein. By way of example, the Medial Wing Layer 245 and Lateral Wing-Pocket Layer 250 may be connected by a closure, such as Closure 505, with or without an internal pocket structure (as illustrated in FIG. 5) and the Portals illustrated in FIG. 10 may be implemented in the Bra illustrated in FIG. 1 or 12.

Fabric discussed in this paper may be made from natural materials such wool, silk, leather, cotton, flax, jute, hemp, and bamboo as well as from synthetic materials such as nylon, polyester, acrylic, elastane (or spandex), olefin fibers, polylactid biopolymers (such as Ingeo®), and blends thereof. Fabrics discussed in this paper may be composites of multiple fabrics and/or other layers, such as the water resistant and breathable materials such as Gore-Tex®. Fabrics discussed in this paper may also be made of or comprise materials which reflect, absorb, or deflect electro-magnetic radiation, such as radio waves.

The bras illustrated in this paper are examples only; other bra types and components may be implemented. For example, the Straps illustrated herein are generally illustrated as being adjustable, whereas in an embodiment, the Straps may not be adjustable or may not be included (such as a strapless bra). For example, the Back of the Bras is not generally illustrated as comprising a fastener, whereas in an embodiment, the Back of the Bra may comprise a fastener, such as a clasp, a zipper, hook-and-loop fasteners, and similar. For example, the Bras illustrated herein do not comprise a front-fastener to connect the two sides of the Bra; in an embodiment the Bra may comprise a front-fastener. For example, the Bras illustrated herein have Straps which do not cross; in an embodiment, the Straps may cross one another or may be incorporated into a "racerback," "hourglass," or "cami back" design.

The above Detailed Description of embodiments is not intended to be exhaustive or to limit the disclosure to the precise form disclosed above. While specific embodiments of, and examples are described above for illustrative purposes, various equivalent modifications are possible within the scope of the system, as those skilled in the art will recognize.

The invention claimed is:

1. A bra comprising:

a first cup and a second cup;

a first wing attached to the first cup and a second wing attached to the second cup;

a pocket in at least one of the wings;

which pocket comprises a medial wing layer and lateral wing layer, a front seam attaching the medial and lateral wing layers, which front seam is proximate to the cup, a bottom hem attaching the medial wing layer and the lateral wing layer along a bottom margin of the wing layers, a rear seam proximate to a back of the bra and substantially perpendicular to the horizontal axis of the wing, and an opening between the medial and lateral wing layers; wherein the opening is longer in the horizontal direction than a vertical height of at least one of the front seam and the rear seam, a top hem of the medial wing layer is above a top hem of the lateral wing layer, and the opening is between a top edge of the top hem of the lateral wing layer and below a top edge of the top hem of the medial wing layer.

2. The bra according to claim 1, wherein the opening is longer in the horizontal direction than a vertical height of at least one of the front seam and the rear seam.

3. The bra according to claim 1, wherein the front seam attaches a rear edge of the cup to the medial and lateral wing layers.

4. The bra according to claim 1, wherein the front seam attaches a cradle to the medial and lateral wing layers.

5. The bra according to claim 1, further comprising a shoulder strap and wherein the rear seam is proximate to the shoulder strap.

6. The bra according to claim 1, wherein said at least one pocket comprises one pocket in each of the wings.

7. The bra according to claim 1, further comprising a high-tack material on a medial surface of the bra, which surface would contact a wearer's torso.

8. The bra according to claim 1, wherein the pocket further comprises a water-resistant layer between the medial wing layer and the lateral wing layer, which water-resistant layer comprises a water resistant material.

9. The bra according to claim 1, wherein the lateral wing layer comprises at least one of a water-wicking material and a water resistant material.

10. The bra according to claim 1, further comprising a first conduit portal in the lateral wing layer.

11. The bra according to claim 10, further comprising a second conduit portal in the medial wing layer.

12. The bra according to claim 1, further comprising a closure configured to close the opening.

13. The bra according to claim 12, wherein the closure comprises a zipper.

14. The bra according to claim 1, further comprising a layer comprising a material which reflects electro-magnetic radiation.

15. A bra comprising:

a first cup and a second cup;

a first wing attached to the first cup and a second wing attached to the second cup, wherein at least one of the wings comprises a pocket;

wherein the wing comprising the pocket comprises a medial wing layer and a lateral wing layer;

wherein the pocket comprises a medial pocket layer, a lateral pocket layer and a closure;

wherein the medial pocket layer is attached to the medial wing layer;

wherein the closure is attached to the medial wing layer, the lateral wing layer, and the lateral pocket layer.

16. The bra according to claim 15, wherein the closure is attached to the medial wing layer and the medial pocket layer along the bottom of a first pocket-wing hem of the wing comprising the pocket and to the lateral wing layer and the lateral pocket layer along a second pocket-wing hem below the level of the first pocket-wing hem.

17. The bra according to claim 15, wherein the medial and lateral wing layers attach along a seam at the intersection of the medial and lateral wing layers and at least one of the cups.

18. The bra according to claim 15, further comprising a bottom hem, which bottom hem comprises an elastomer.

19. The bra according to claim 15, wherein at least one of the medial pocket layer and the lateral pocket layer comprises a water resistant material.

20. The bra according to claim 15, further comprising a high-tack layer on a medial surface of the bra, which surface would contact a wearer's torso.

21. The bra according to claim 15, wherein the medial and lateral pocket layers are formed by folding one piece of material along a bottom margin of the pocket.

22. The bra according to claim 15, further comprising a shoulder strap and wherein the medial wing layer, the lateral wing layer, the medial pocket layer, and the lateral pocket layer are attached along a substantially vertical seam proximate to the strap.

23. The bra according to claim 15, wherein the closure comprises a zipper.

24. A bra comprising:

a first cup and a second cup;

a first wing attached to the first cup and second wing attached to the second cup, wherein at least one of the wings comprises a pocket;

wherein the pocket is formed by attachment of a medial wing layer and a lateral wing layer along a top hem, a bottom hem, and a rear seam, with an opening along a margin between the lateral wing layer and the cup.

25. The bra according to claim 24, further comprising a closure connecting a first side of the opening to a second side of the opening.

* * * * *